United States Patent [19]

Ciucani

[11] 4,388,880

[45] Jun. 21, 1983

[54] MACHINE FOR STITCHING THE UPPER BORDER OF SHOES COMMONLY CALLED MOCCASINS

[76] Inventor: Mario Ciucani, Via dell'Universita, 16, Fermo, Italy

[21] Appl. No.: 184,366

[22] Filed: Sep. 5, 1980

[30] Foreign Application Priority Data

Sep. 7, 1979 [IT] Italy ..... 3488 A/79
Apr. 30, 1980 [IT] Italy ..... 3406 A/80

[51] Int. Cl.[3] ..... D05B 15/02; D05B 27/08; D05B 27/20

[52] U.S. Cl. ..... 112/49; 112/132; 112/310; 112/312; 112/321

[58] Field of Search ..... 112/49, 132, 133, 310, 112/311, 312, 313, 321

[56] References Cited

U.S. PATENT DOCUMENTS

| | | | |
|---|---|---|---|
| 3,256,844 | 6/1966 | Chezaud et al. | 112/311 |
| 3,530,809 | 9/1970 | Porter | 112/311 |
| 3,954,071 | 5/1976 | Mall et al. | 112/311 |
| 3,970,018 | 7/1976 | Hager | 112/310 |
| 4,274,345 | 6/1981 | Schneider et al. | 112/312 X |

*Primary Examiner*—H. Hampton Hunter
*Attorney, Agent, or Firm*—Fleit, Jacobson & Cohn

[57] ABSTRACT

Disclosed herein is a machine with which it is possible to effect the stitching between the vamp and the upper part of the shoe and thus to create the upper border on "moccasin" type shoes, in particular, those of the "tubular moccasin" type, which utilize a continuous end sealed vamp. An improved ruffling of the vamp prior to attachment to the upper portion is accomplished by synchronized ruffling jaws. The machine operates in a fully automatic fashion and has the capability to vary the length of the stitch and of the ruffle of the vamp in the region of the upper part of the shoe.

12 Claims, 19 Drawing Figures

FIG1
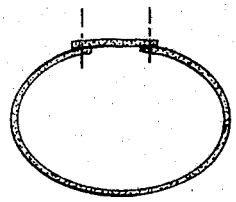
FIG2
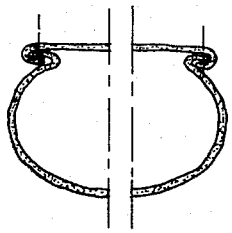
FIG12
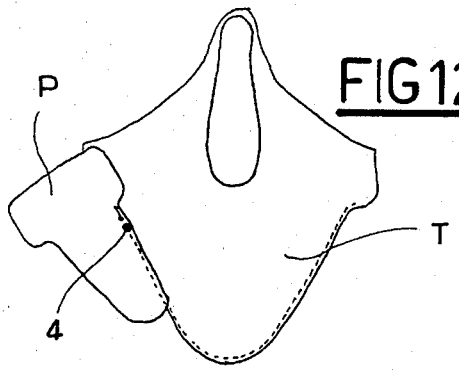
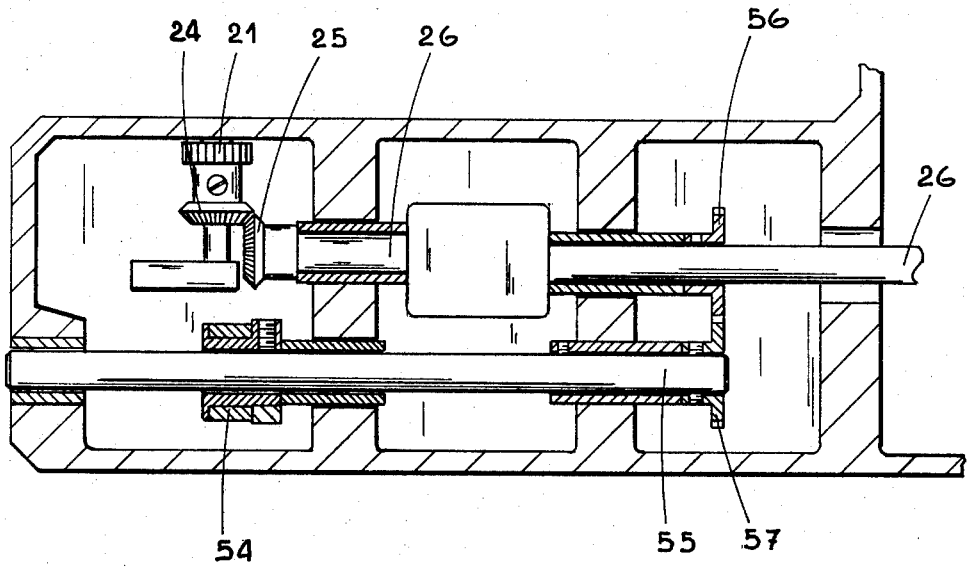
FIG5

FIG 6
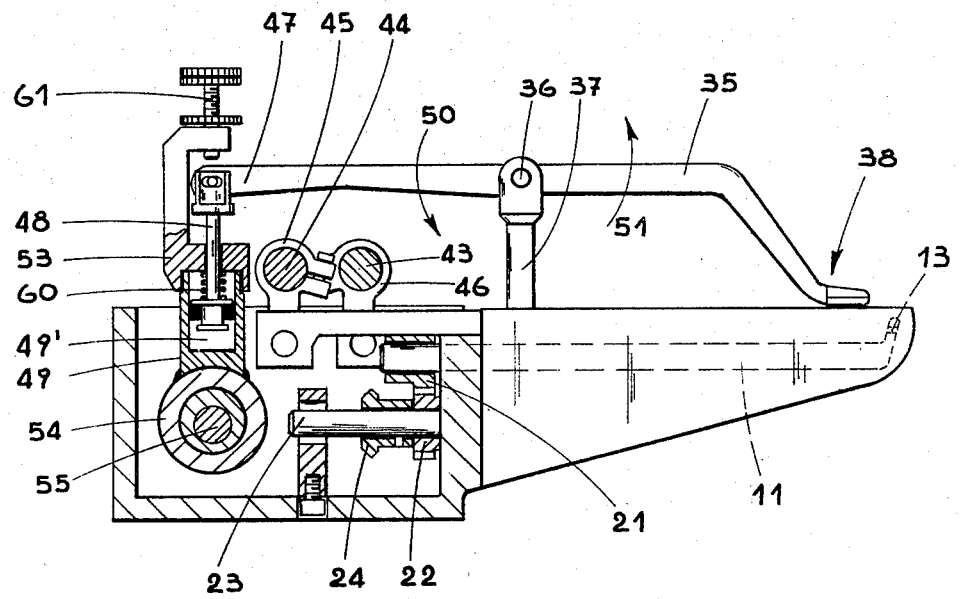
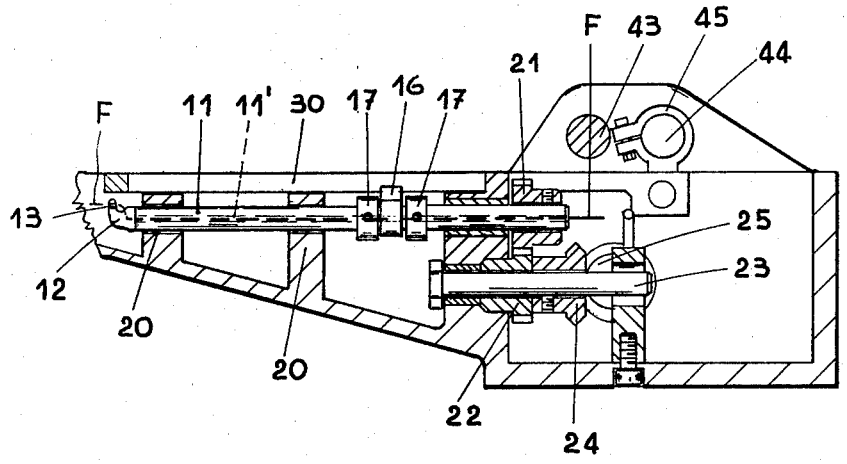
FIG 7

MACHINE FOR STITCHING THE UPPER BORDER OF SHOES COMMONLY CALLED MOCCASINS

BACKGROUND OF THE INVENTION

The invention relates to a machine for stitching the upper border of shoes commonly called moccasins.

DESCRIPTION OF THE PRIOR ART

The shoes commonly called "moccasins", are a type of footwear, generally made of soft leather and devoid of laces, that consist of a lower part, or vamp, either open at the end or closed (in the case of tubular moccasins) the vamp being joined to an upper part which constitues the sealing element of the shoe. Moccasins such as these up until a short time ago were produced exclusively by hand and only recently have been manufactured on an industrial scale.

The machines currently available customarily execute a lock stitch using the oscillating shuttle typical of conventional sewing machines. This however, in the case of stitching shoes, requires thread of a heavy gage and involves, as a consequence, the use of sewing carrier arms of a considerable size because of the presence of large diameter shuttles. Thus, with conventional machines it is not possible to carry out the stitching of a moccasin of the tubular type because an arm of such a size cannot penetrate inside the tip of the shoe under formation. This is why conventional sewing machines do not effect a simple stitching of the shoe upper to the vamp with the former simply laid over the latter and with the penetration of the needle and thread from the outside of the shoe into the inside of the space delimitated by the tube formed by the moccasin (as illustrated in FIG. 1). Instead, conventional sewing machines must resort to stitching along a "border" defined by folding the shoe upper onto the vamp in such a way as to stitch one to the other with the needle always remaining outside the space delimitated by the tube of the moccasin (as illustrated in FIG. 2).

Furthermore, in order to achieve the stitching between the vamp and the shoe upper, and since the perimeter of the former is considerably greater than that of the latter, it is necessary, at the time of stitching, to ruffle the border of the vamp by the amount needed to reduce it to the same length as to border of the shoe upper. For this reason, footwear of the moccasin type used to be made solely by hand and only recently have machines for this purpose been introduced. Existing machines utilize, for the ruffling operation, a pair of "jaws" that grip the hide of the vamp on opposite sides and are moved by separate coordinated systems of levers, on with respect to the other. Depending upon the nature and the density of the hide, this can render difficult a fully harmonious forward movement of the jaws and cause consequent trouble in the infeeding and the ruffling of the vamp.

SUMMARY OF THE INVENTION

One essential object of the invention is, therefore, to overcome the aforementioned difficulties through the creation of a machine with which it is possible to achieve the stitching between the shoe upper and the vamp, of the upper border, on moccasin footwear of the tubular type, by simply superimposing the former over the latter.

A further object of the invention is to provide, for the vamp ruffling operation, a pair of jaws that are able to effect for the infeeding of the hide, a thoroughly harmonious forward movement with a resulting constant and perfect infeeding and ruffling operation, independently of the working conditions and the nature of the hide.

Another object of the present invention is to be able to regulate, irrespective of the length of the stitch, the amount by which the vamp needs to be ruffled.

These and other objects are achieved with the machine forming the subject of the invention. The present invention relates to a sewing machine of the type comprising a base body provided at the front with an overhanging head that contains and supports the needle and the relevant devices for the movement thereof in a reciprocating fashion in two directions: a longitudinal movement towards and from a horizontal arm or working surface that lies below; and a traversing movement, perpendicular to its own axis, for infeeding the material in a direction parallel to the axis of the working surface or arm. The machine is further provided with a first jaw, movable along the working surface and synchronized with the traversing movement of the needle, the jaw constituting a movable working surface on which the flaps of material to be stitched are placed and, further comprising a first presser foot supported in an overhanging fashion by the aforementioned head, this also being movable, similarly to the needle, longitudinally and transversely, operating alternately with the said first jaw, and being able to lock the material and to displace it in time with the traversing movement of the needle. The said machine also has a second presser foot to the rear of the first presser foot, movable in the above-mentioned longitudinal direction and, in conjunction with the working surface, locking the previously stitched material transported by the needle-first presser foot-first jaw assembly.

The needle is of the hook type. The machine also has a looping mechanism rotatable in a single direction which, in turn, comprises a tail piece provided with a hole through which the stitching thread passes, the looping mechanism being placed beneath the plane of the said first jaw and being rotatable around an axis parallel to the traversing axis of the first jaw. Means are provided for reciprocating the looping mechanism along a path defined by the axis of rotation thereof, harmoniously and in time with the traversing motion of the first jaw. The machine further comprises second and third jaws that define a pair of "gripper" restraining elements, provided for the infeeding and the ruffling of the material, the second jaw being placed laterally adjacent the first jaw, and reciprocating parallel to and in time with the first jaw but in the reverse direction to that in which the first jaw moves, the third jaw being pivotally united to the second jaw, placed above and in contract therewith, with means being provided for the corresponding rotating gripping and releasing movement of the pair of jaws in time with the traversing movement of the second jaw.

BRIEF DESCRIPTION OF THE DRAWINGS

Further characteristics and advantages of the machine according to the invention will become apparent from the following detailed description of a preferred embodiment, illustrated purely as an example in the accompanying drawing, in which:

FIGS. 1 and 2 show diagrammatically, along a cross section, one example of stitching between the shoe upper and the vamp as performed on the machine forming the subject of the invention (FIG. 1), and on conventional machines (FIG. 2);

FIG. 5 shows the machine in cross section on a plane parallel to that in FIG. 4 but at a lower elevation with respect to the working surface, with further moving parts of the looping mechanism and the jaws illustrated;

FIG. 6 is a cross section along the section 6—6 of FIG. 4;

FIG. 7 is a cross section of the machine along the section 7—7 of FIG. 4;

FIG. 12 shows, diagrammatically, the position of the vamp with respect to the shoe upper during the stitching operation;

DESCRIPTION OF THE PREFERRED EMBODIMENT

Figure 3:
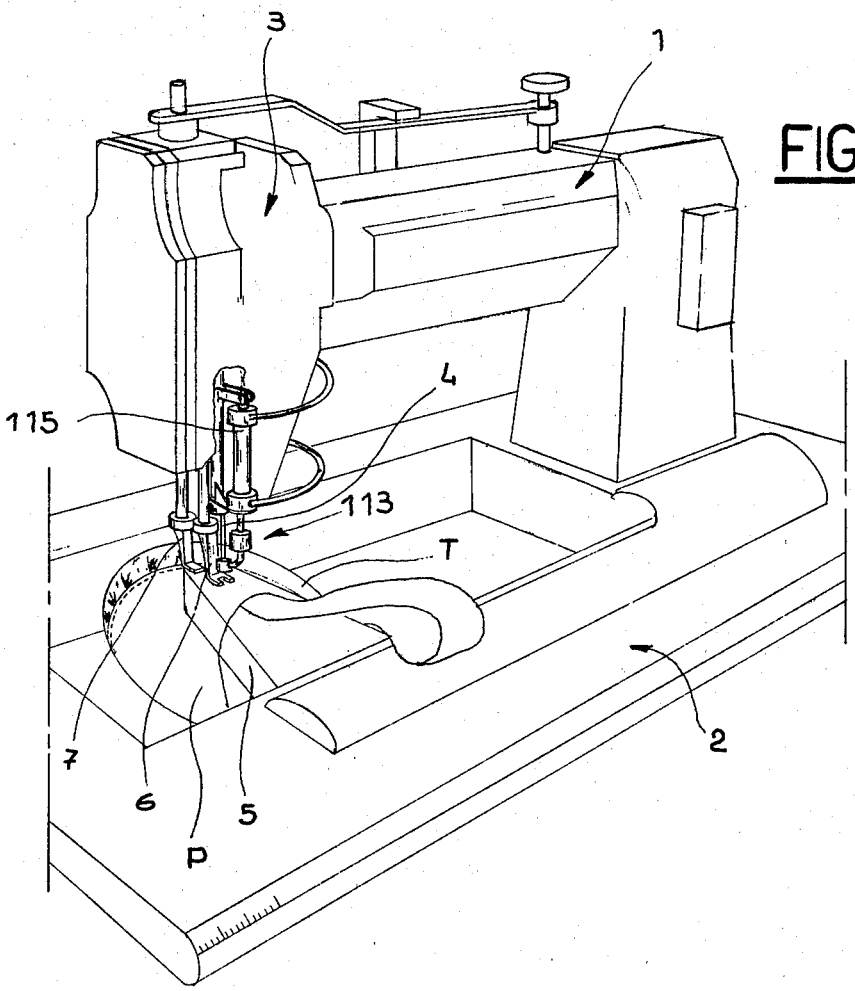
FIG. 3 shows a perspective overall view of the machine in question.

With reference to the accompanying figures and, in particular, to FIG. 3, the machine in question essentially comprises an upper body, shown at 1, and a lower horizontal body, shown at 2, the latter connected to the former.

The upper body 1 comprises, at one extremity thereof, a vertical overhanging head 3 from which protrudes a needle 4, the movements of which are controlled, in a way that is well known, by mechanism housed in the inside of the said upper body 1.

Figure 10:
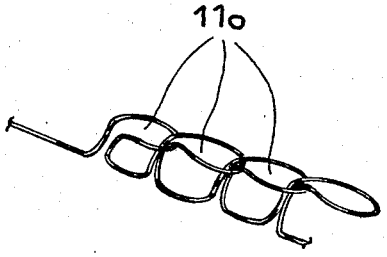
FIG. 10 shows, diagrammatically, one example of the stitch made by the machine in question.
Figure 9:
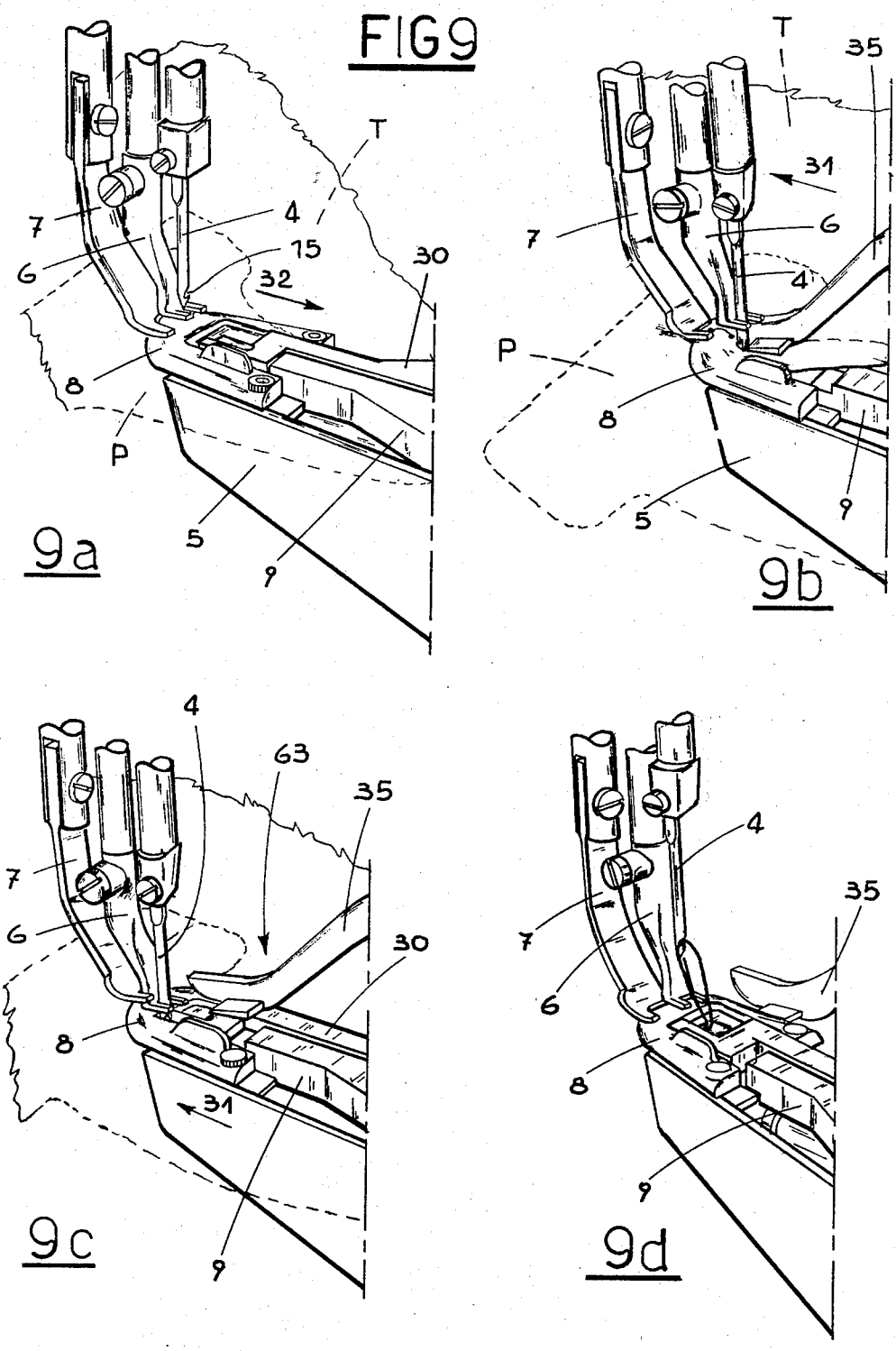
FIGS. 9*a*–9*d* shows, in a diagrammatic perspective view, the arrangement of the machining devices in a first embodiment at various stages in the stitching operation.
Figure 13:
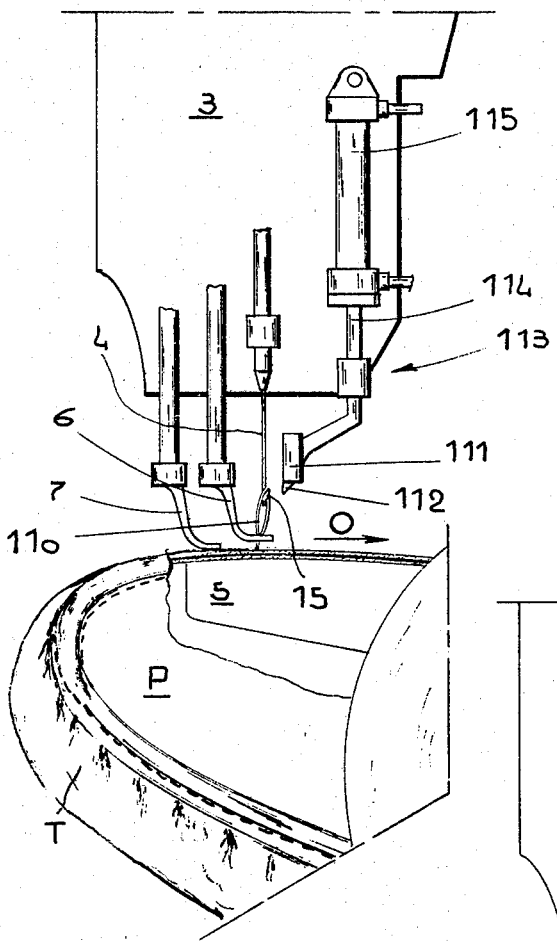
FIGS. 13, 13*a*, 14 and 14*a* show a lateral, partially cross section, view of the device, according to two further embodiments and illustrate the various machining devices at two different stages in the stitching.
Figure 14:
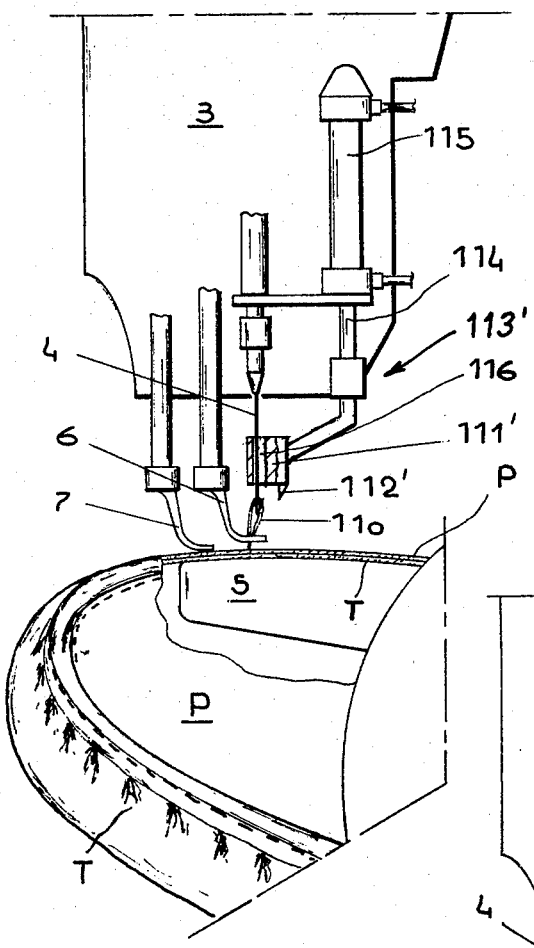

Underneath the needle 4, the body 2, which extends substantially in a "U" conformation, is provided with a working surface or arm 5, of a small diameter tapered tubular shape. The working surface is tapered at the free extremity underneath the needle 4 and constitues the contact and resting surface for the material to be stitched, while the member supporting the movement jaws and that in which the looping mechanism is contained constitute, together with the needle, the fundamental parts for the stitch formation portion. The device forms what is called a "chain" stitch, illustrated diagrammatically in FIG. 10, wherein a single thread is used, and is made to pass through the loop of the previous stitch in order to form a locked chain stitch. For the formation of the stitch the needle 4 is provided with a hook 15 (as can be seen in FIGS. 9, 13 and 14) and this, at the time the needle rises, grasps the loop of the thread that is formed by the looping member.

The parts that constitute the machine will now be described, leaving the operation thereof to a subsequent description.

Figure 4:
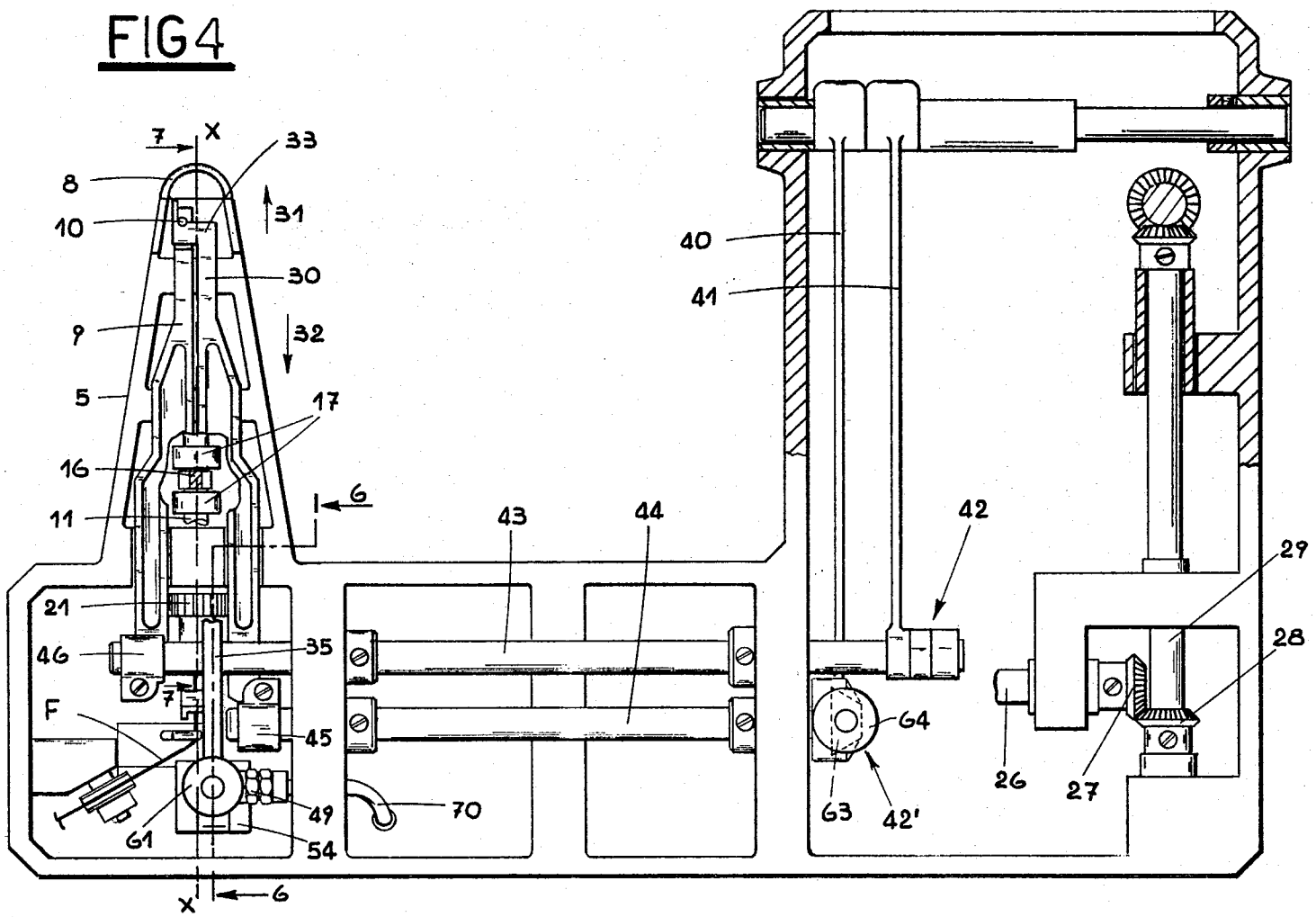
FIG. 4*a* shows the machine, along a cross section through the plane of the jaws, and illustrating the moving parts of the jaws.

The needle 4 is given, via known means contained in the body 1, a vertical or longitudinal reciprocating motion whereby it penetrates into and exits from the material to be stitched, and contemporaneously, a horizontal or transverse reciptrocating motion, perpendicular to its own axis and directed parallel to the axis of the working surface 5, that is to say, parallel to the axis x-x in FIG. 4.

To the rear of the needle 4 is placed a first presser foot 6 (FIG. 1), which is also provided with vertical and horizontal oscillatory motion similar to that of the needle and which acts as a member for gripping the material to be stitched in conjunction with a first movement jaw 9 placed above the arm 5 and extending on the work surface plane as illustrated in FIG. 4.

The jaw 9 is provided, in the head thereof, with a through hole 10 which is penetrated by the needle 4 as it goes to fetch the thread for the stitching. In this connection, the jaw 9 is given a horizontal, reciprocating motion along the axis x-x, the motion being synchronized with the horizontal reciprocating motion of the needle 4.

The needle 4-first presser foot 6-first jaw 9 constitutes an assembly that moves the material forward by an amount representing the length of the stitch. This amount can obviously be varied by means of known devices contained in the body 1 in order to adjust it to the design requirements and to the material.

To the rear of the first presser foot 6, again supported in an overhanging fashion by the head 3, there is a second presser foot 7, movable only in a longitudinal reciprocating fashion, which, in its lowest position, comes into contact with a fixed contact surface 8 that constitutes an integral part of the most forward portion of the working surface 5. This second presser foot has the task of keeping the previously stitched material locked and of restraining the stitch during the non-sewing return movement of the needle 4.

Figure 11:
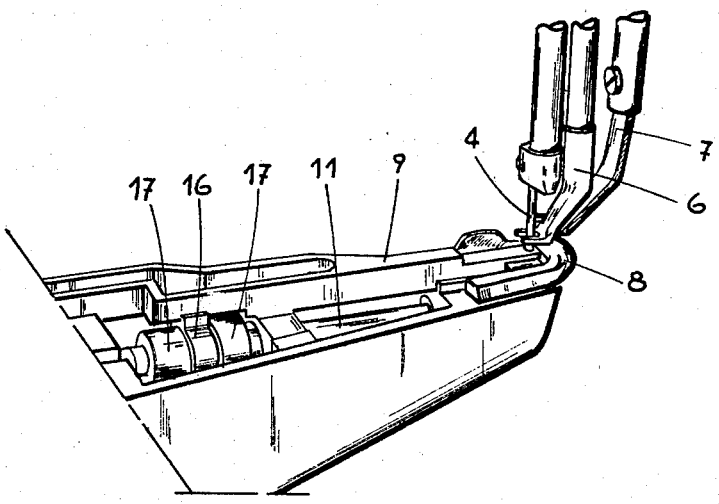
FIG. 11 is a perspective view of the looping mechanism with certain parts of the machine removed in order that others may be more visible.

The second element which, together with the needle, contributes to the formation of the stitch is looping a member 11 (see FIGS. 4, 7 and 11) which comprises a hollow horizontal shaft 11 rotatably mounted on an axis (shown as x-x in FIG. 4) and terminating at its free extremity in an eccentric tail piece 12. The tail piece is provided with a hole through which the thread F for the stitching is made to pass.

The looping means is contained inside of the working surface or arm 5, beneath the jaw 9, and is positioned, with respect to the needle 4, in such a way as to always have the tail piece 12 placed adjacent the needle, on the side of the needle opposite to the first presser foot 6, and on the side of the needle containing the hook 15. In order that this be possible, since the needle is provided with a horizontal traversing movement, the looping member 11 is locked to the first jaw 9 through a vertical projection 16, integral with the jaw 9 and provided with a hole through which the looping member 11 can pass. The looping member 11 has two movable shoulder members 17 that can be locked to the looping member 11 on opposite sides of projection 16. In this way the looping member 11 can reciptrocate along the axis x-x in synchronous relation with the oscillation of the needle 4 and remain correctly positioned with respect thereto (the movement of the jaw 9 being synchronized with the movement of the needle 4). Looping member 11 is able to rotate around its own axis x-x while reciprocating.

The rotation of looping member 11, which takes place in one single direction, is necessary for the formation of the loop of the thread which is picked up by the hook 15 of the needle 4.

The rotation movement of the looping member 11 (see FIGS. 7 and 5) (supported by the reinforcing ribs 20 of the working surface or arm 5), is provided by a pair of straight tooth gears 21–22, the latter fixedly mounted on a secondary shaft 23 whose rotation is controlled by a pair of helical gears 24–25 incident thereon and angled at 90°. The helical gear 25 is keyed to the shaft 26 which constitutes the primary drive shaft, its motion being taken, as can be seen in FIG. 4, via a further pair of helical gears 27–28 and a shaft 29, from the drive mechanism of the entire machine (not shown) which also drives the previously described devices of the overhanging head 3.

It is important to note that the mating of the straight teeth between the helical gears 21–22 is necessary in order to allow the contemporaneous continuous rotation of the shaft 11 and the horizontal traversing thereof along the axis x-x.

At the side of the first jaw 9, in the same plane thereof, is placed a second jaw 30, also movable horizontally in a reciprocating fashion in the directions of the arrows 31 and 32 (FIG. 4) and which terminates in a free extremity 33 of a "Z" conformation that partially overlays the first jaw 9. The movement of the second jaw 30 is the reverse to that of the first jaw 9 and is such that when the latter (jointly with the needle 4 and the first presser foot 6) moves in the direction shown at 32, the second jaw 30 moves in a direction corresponding to that shown by the arrow 31; the movement of the jaws is regulated so that when the two jaws meet at the maximum approach point (the position illustrated in FIG. 4), the extremity 33 of the second jaw 30 is located in the immediate vicinity of the needle 4, almost in contact therewith.

Above the second jaw 30 (see FIG. 6) is placed a third jaw 35 pivoted, loosely, at 36, to a vertical bar 37 which is integral with the second jaw 30. Third jaw 35 is oriented in such a way that the horizontal displacements of the second jaw 30 are passed on in full to the third jaw 35.

The latter, at the free extremity 38, is of a "gripper" configuration so as to provide, when rotated around the pivoting point 36, in conjunction with the extremity 33 of the second jaw below, tongs that are able to grasp and keep a tight hold on the material there interposed, which in the case under consideration consists of the vamp of the footwear to be stitched.

The horizontal reciprocation of the jaws 9 and 30 (and passed on by the latter to the jaw 35) is controlled by a pair of rocker arms 40–41 (FIG. 4) which are connected to the usual main drive mechanism (not shown) and, through the link rods 42–42', control the reciprocating rotation of the shafts 44 and 43, respectively, which, in turn control, via the link rods 45 and 46, the horizontal movement of the jaws 30 and 9, respectively.

Insofar as the rotation of the third jaw 35 in the direction of the arrows 50 and 51 in FIG. 6 is concerned, the lower extremity 47 of the jaw has pivotally connected thereto the rod 48 of a pneumatic piston 49, the body of which is integrally formed with a "U" shaped member 53 and with a sleeve 54 rotatable eccentrically around a shaft 55 kept in continuous rotation by the main shaft 26 through a pair of gearwheels 56 and 57.

In this way by keeping air under pressure in the inside of the lower chamber 49' of the piston 49, via a duct 70 (FIG. 4), the continuous rotation of the shaft 55 through the eccentric sleeve 54 causes the third jaw 35 to rotate about pivot 36 in both directions, with respect to the jaw 30 below and to cause the extremities 38 and 33 to alternately approach and move away from one another, with the consequent gripping and releasing of the material placed in between them.

The presence of the piston 49 serves when, at the commencement of the operation, it is wished to insert the material to be stitched between the jaws 30 and 35. In that case the operator takes appropriate action to release the air pressure from the chamber 49', allowing the action of the spring 60 to bring about a greater rotation in the direction of arrow 51 and, therefore, the opening of the jaw 35. The "U" shaped member 53 has the task, through the adjusting screw 61, of regulating the minimum closing distance between the two jaws 30 and 35 to suit the gage and the nature of the material.

With respect to FIG. 4, it can be seen that the intermediate link rod 42' connecting the shaft 44 to rocker arm 40 is not of a fixed length but has constituted a dovetail connection 63 movable in a direction perpendicular to the working surface and adjustable by means of a screw 64 so as to be able to vary the amount of the horizontal or transverse movement of the pair of jaws 30 and 35 for the reasons that will be outlined below.

With the aid of FIGS. **9*a* through 9*d*** a brief description of the operation of the above described machine will now be given.

Figure 8:
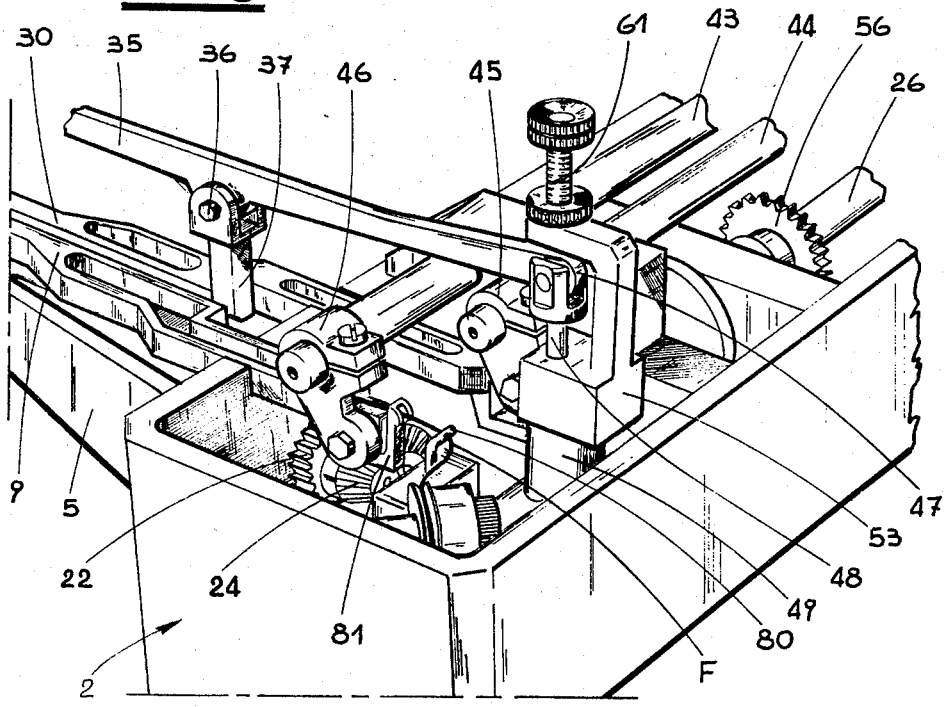
FIG. 8 shows, diagrammatically and in a perspective view, the essential parts of the mechanism that comprises the machine in question.

The stitching thread F, coming from the lower part of the body 2 (shown in FIG. 8) and passing through the successive guides 80 and 81, passes through the longitudinal hole 11' in the looping member 11 and then passes through the hole 13 made in the extremity of the tail piece 12 (see also FIG. 6).

As the looping member 11 rotates, it forms a loop that is grasped by the hook 15 of the needle 4 during its upward movement.

At the commencement of the stitching, the vamp T (see FIGS. 3 and 12) is placed with the surface that is to constitute the inner part of the shoe turned downwards, with the border to be stitched inserted in between the pair of jaws 30 and 35; the supply of pressurized air to the piston 49 being interrupted for this particular operation. The shoe upper P is similarly placed, with the surface that is to constitute the inner part of the shoe turned downwards, and is positioned above the vamp with the border to be stitched lightly and simply positioned over the corresponding border of the vamp. Let it now be assumed that the configuration is as shown in FIG. **9*a***, in which:

- the second foot 7 is lowered and is pressing down against the fixed surface 8, the complex consisting of the shoe upper P and the vamp T which has been stitched and from the top of which protrudes the loop resulting from the previous upward travel of the needle 4;
- the needle 4 and the first foot 6 in the raised position are, together with the first jaw 9, carrying out the first stage in the stitching and are moving in the direction of the arrow 32;
- the pair of jaws 30 and 35, timed to grip the vamp (see the position of the eccentric sleeve 54 in FIG. 6), under the action of the shaft 44 and the link rod 46, commence their active travel in the direction shown at 31 (FIG. 9*b*) and in this way bring about the progressive ruffling of the vamp, since the shoe upper and the vamp are locked by the second presser foot 7, As the operation proceeds, the configuration shown in FIG. 9*b* is arrived at, and in this:

the second foot 7 is still in the lowered position;

the needle 4, in its maximum forward position, is in the process of going, between the previous loop kept in contact with the material by the first foot 6 now in the lowered position (in opposition with the first jaw 9, into the shoe upper and the vamp in order to commence a fresh stitch);

the pair of jaws 30 and 35 is in the maximum position of approach to the needle, that is to say, for the maximum ruffling of the vamp.

Continuing, the needle carries on its penetration, completes its downward travel and, through the rotation of the looping member siezes hold of a further loop of thread F. At this point the relative movements are inverted and:

the second presser foot 7 is raised;

the jaws 30 and 35 open;

the first foot 6, lowered and pressed (with the material in between) up against the first jaw 9, is completing the second stage in the stitching, that is to say, the moving forward in the direction shown at 31 of the stitched material, while;

the jaws 30 and 35, in the open position, are effecting passive travel in the direction of the arrow 32 in order to go and seize hold of fresh material to be ruffled (position as per FIG. 9*c*).

Once the forward travel is over, the configuration 9*d* is arrived at, in which:

the second foot 7 is again in the lowered position for the locking of the stitch;

the first foot 6 is raised in order to free the thread which is thus pulled by the needle 4 which is moving upwards after having hooked to it a fresh loop for the repetition of the above described operations.

It is important to note that the machine in question, utilizing the special described looping member 11 of greatly reduced dimensions and using a hook type needle is able to employ to work surface or arm of very small diametrical dimensions, one that can be threaded into the inside of the tube constituting the moccasin, or better still, one that it is able to stitch the moccasin around the arm using a stitch that goes from the outside to the inside, as can be seen in FIG. 1, that is to say, with the shoe upper portion simply superimposed over the vamp. This is an improvement over the contrary method shown in FIG. 2 achieved on conventional machines which require a looping member of significantly larger dimensions and thus are not able to allow the arm to penetrate inside the moccasin, which therefore necessitates the stitching being completely external with the shoe upper folded back.

Another considerable advantage to the present invention is derived from the fact that the pair of ruffling jaws 30 and 35 are inter-connected in such a way that the traversing movement given to one is transmitted unvaried to the other; this makes it possible to vary the amount by which the vamp is ruffled to suit the different design or material requirements, with the certainty of the operation always being done well.

Furthermore, the presence of the dovetail connection 63 enables the travel of the jaws 30–35 to match the length of the stitch, in such a way that all of the ruffled material is stitched. This is accomplished by moving the second jaw 30, once its active travel is over, until it is almost in contact with the needle 4 when the needle is about to go into the material, as shown in the configuration in FIGS. 4 and 9*b*.

Recapitulating, it can thus be said that the movements of the needle and of the first presser foot 6 are coordinated in such a way as to have the following stages starting when the needle 4, having hooked the stitching thread, is in the maximum upward position and has drawn the thread until a loop of thread has been formed above the material to be stitched:

(a) the needle 4 traverses in the opposite direction to that in which the material to be stitched moves forward, and the presser foot 6 contemporaneously moves in the same direction, causing the loop formed to rest tightly on the material to be stitched;

(b) the needle 4 penetrates the material to be stitched, passing through the already formed loop until a fresh hooking position of the stitching thread has been reached;

(c) the needle 4 and presser foot 6 traverse in the same direction as that in which the material to be stitched moves forward, the said material gripped and moved by the presser foot 6-jaw 9 combination;

(d) the needle 4 returns to the maximum upward position with the freshly hooked loop held taut forming a fresh loop of stitching thread.

It has been seen that when the stitch is made in the above described fashion, particularly at high operating speeds, the loop formed by the needle 4 subjected to the action of the first presser foot 6 can, at times, incorrectly position itself, that is, it can fail to reach the resting position on the material to be stitched and outside the downward path followed by the needle 4 which, thus, cannot pass through the previously formed loop (during the stage b) and, therefore, cannot give rise to a stitch.

In order to avoid this problem a second embodiment of the machine includes a device 113 (see FIGS. 13 and 14) for centering and guiding the loop of thread formed by the needle 4 while it travels upward towards its maximum upward position. The loop, shown at 110 in FIG. 13, has to have the needle 4 passing through it during the commencement stage of a stitch subsequent to the one already made. The device 113 is positioned, with respect to the needle 4, diametrically opposed to the presser foot 6 and, in accordance with the illustration in FIGS. 13 and 13*a*, comprises a head 111 positioned in proximity to the needle 4, the lower part of which is provided with a pointed projection 112. Pointed projection 112 serves to center and guide the loop 110 when it is released by the needle 4 and subjected to the action of the presser foot 6, in order to rest it on the material to be stitched, as illustrated in FIG. 13*a*.

The head 111 is connected to the rod 114 of a pneumatically operated piston that slides in the inside of a cylinder 115 which is supported by the overhanging head 1. Piston rod 4 reciprocates longitudinally to and from the working surface or arm 5, and is synchronized with the movements of the needle 4 and the presser foot 6.

Figure 13A:
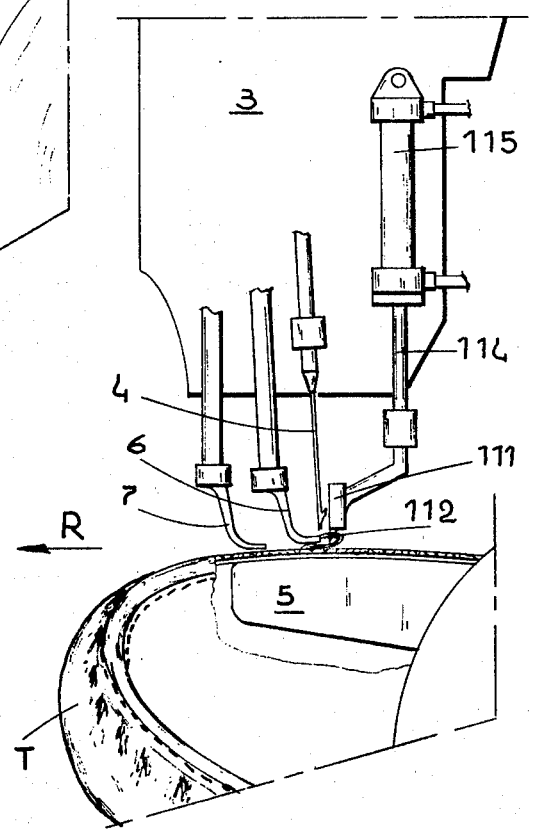

In accordance with the foregoing description, the needle 4 and the presser foot 6, in the raised position, move in the direction of the arrow 0 in FIG. 13 (this being the reverse of that in which the material to be stitched moves forward which is shown by the arrow R in FIG. 13*a*), and while reaching the maximum travel position in the direction of the arrow 0, the needle 4 commences a downward movement and frees the loop 110. The foot 6 presses on the base of the loop 110 and starts to lower it onto the material to be stitched and to project it towards the centering and guiding device 113, as shown in FIG. 13*a*. At this juncture, air is sent to the inside of the cylinder 115 causing the rapid expulsion of the rod 114 and the consequent fast downward displacement of the head 111 of the device 113 and, in this way, causing the pointed projection 112 to be threaded into the loop 110 and to carry it tightly up against the material to be stitched. Due to the fact that the pointed projection 112 is aligned with the needle 4 in the horizontal movement direction of the latter, it is obvious that the loop 110 is, in the said position, centered perfectly with respect to the needle itself.

Upon completion of this stage, the presser foot 6 is lowered and exerts a vise hold on the vamp shoe-upper portion complex, while the needle 4 continues to move downwards and, passing through the previously made loop 110, gives rise to a fresh stitch. When the needle 4 reaches the maximum downward displacement position, it moves, as does the presser foot 6, in the direction of the arrow R (FIG. 13*a*) immediately after both the presser foot 7 and the head 111 of the device 113 have been carried in the raised position with respect to the working surface or arm 5.

It is obvious that the centering of the loop 110 with respect to the needle 4 is always ensured by the device 113 which is depending on the desired programmed length of the stitch, suitably positioned, with respect to the needle 4, at the commencement of the working cycle.

Figure 14A:
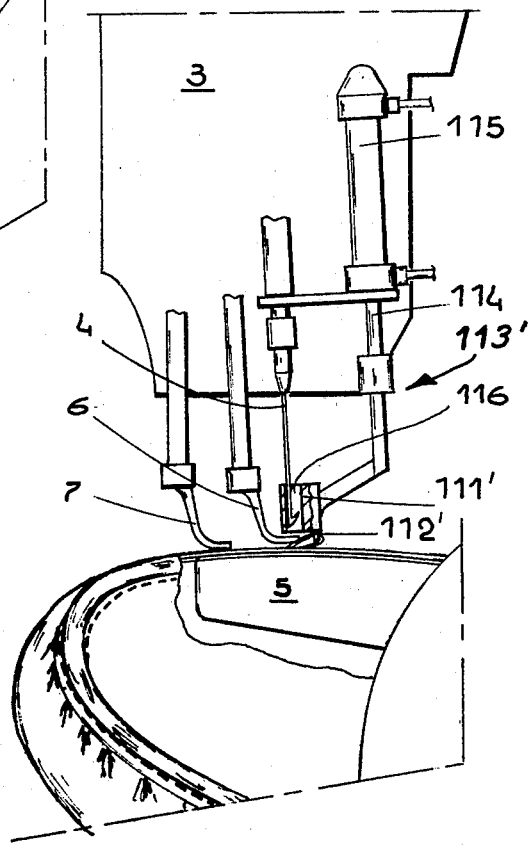

According to a third embodiment illustrated in FIGS. 14 and 14*a*, the head 111' of the device for centering and guiding the loop 110 is provided with an axial hole 116 through which the needle 4 passes freely, and the cylinder 115 is connected to the devices for the horizontal traversing movement of the needle 4. In this way, the pointed projection 112' follows the traversing movement of the needle 4 and, when this movement is varied to suit the length of the stitch it is wished to produce, there is not need to correspondingly adjust the position of the centering and guiding device 113' with respect to the needle 4.

What is claimed is:

1. A machine for stitching together first and second pieces of material using stitching thread in order to form a joint and border in shoes commonly called moccasins, said machine comprising:

a fixed planar work surface defining a work surface plane on which said material is disposed for stitching;

an elongated needle disposed so that its longitudinal axis is perpendicular to said work surface plane, said needle having a hook formed in the end of said needle nearest the work surface;

first reciprocating means for longitudinally reciprocating said needle along a first line of movement corresponding to its longitudinal axis, said reciprocation causing said hook in said needle to pass back and forth through said work surface plane;

second reciprocating means for transversely reciprocating said needle along a second line of movement, said second line of movement lying along said work surface plane and intersecting said first line of movement;

looping means for forming a loop of stitching thread, said looping means disposed on the opposite side of said work surface plane from said needle, said hook in said needle serving to engage said loop of stitching thread, and said longitudinal reciprocation of said needle serving to draw said loop of stitching thread through said material and through a previously formed loop, said transverse reciprocation in combination with said longitudinal reciprocation serving to pass said needle back through said material to form a chain stitched joint;

feeding means for moving said material along said second line of movement toward said needle;

pressing means for releasably holding previously stitched material in fixed relation to said work surface;

and gripping means for gripping said first piece of unstitched material and for moving said first piece of material towards said needle, independently from said second piece of material.

2. A machine as recited in claim 1, wherein said feeding means comprises:

a first presser foot assembly movably disposed parallel to said first line of movement and able to reciprocate in both said first and second movement directions;

a first jaw movably disposed on said work surface; and means for synchronously reciprocating said first presser foot assembly and said first jaw along said second axis of movement, and for reciprocating said first presser foot assembly along said first axis of movement, said reciprocations alternately gripping and releasing said shoe material and causing it to be moved toward said needle.

3. A machine as recited in claim 2, wherein said pressing means comprises:

a second presser foot assembly disposed parallel to said first axis of movement, and spaced a greater distance from said needle than said first presser foot assembly, said second presser foot being able to reciprocate along said first line of movement; and means for synchronously reciprocating said first and second presser feet so that they alternately engage said material.

4. A machine as recited in claim 2, wherein said gripping means comprises:

a second jaw disposed adjacent to said first jaw on said work surface, and movable along said second line of movement;

a third jaw pivotably attached to said second jaw and movable therewith along said second line of movement;

means for reciprocating said second jaw along said second line of movement; and means for pivoting said third jaw in relation to said second jaw so that it alternately grips and releases said material in a synchronous relation to said reciprocal movement of said second jaw.

5. A machine recited in claim 2, wherein said looping means comprises:

a tubular shaft disposed parallel to said second line of movement on the side of said work surface plane opposite said needle and through which said stitching thread passes;

a tail piece rotatably mounted on said tubular shaft and disposed adjacent to said first jaw;

and wherein said first jaw further comprises a projection extending through said work surface plane and which rotatably supports said tail piece.

6. A machine as recited in claim 5, wherein said tail piece is disposed adjacent to said first line of movement, and wherein rotation of said tail piece about the longitudinal axis of said tubular shaft occurs in a plane parallel to and adjacent said first line of movement, and wherein said tubular shaft and tail piece are disposed on the side of the needle having said hook.

7. A machine as recited in claim 4, wherein said second jaw comprises a free end adjacent to said first line of movement, and a second end attached to said means for reciprocating said second jaw, and wherein said first jaw comprises a free end located adjacent to said first line of movement, and a second end attached to said means for synchronously reciprocating said first presser foot assembly in relation to said first jaw, and wherein said free end of said first jaw is recessed below said working surface, and said free end of said second jaw is superimposed over said free end of said first jaw within said recess between said free end of said first jaw and said working surface.

8. A machine as recited in claim 4, wherein said means for pivoting said third jaw in relation to said second jaw comprises:

a shaft to which a constant rotational movement is imparted; and an eccentric sleeve mounted upon said shaft;

and wherein said third jaw comprises:

a first end of said third jaw located adjacent to said needle, and cooperating with said second jaw in order to move said shoe material along said second line of movement;

a second end of said third jaw located further from said needle than said first end;

a pivot disposed between said first and second ends of said third jaw so that the movement of one end in a given direction results in the movement of the other end in an opposite direction;

and wherein said means for pivoting said third jaw further comprises connecting means for connecting said eccentric shaft to said second end of said third jaw causing said second end to reciprocate in a given direction and causing said first end to reciprocate in an opposite direction.

9. A machine as recited in claim 4 further comprising drive means, and wherein said means for reciprocating said second jaw along said second line of movement further comprises a first link rod, a shaft, a second link rod, and a rocker arm, said rocker arm being connected to said drive means, and serving to impart a reciprocal motion to said shaft, said second link rod and said shaft being joined by a dovetail connection which allows the length of said second link rod to be varied thereby reducing the magnitude of the reciprocation of said shaft, said shaft being connected to said second jaw by said first link rod.

10. A machine as recited in claim 1, further comprising guiding means for centering and guiding said loop of stitching thread after said loop has been pulled through said material and before the stitch is completed by said needle passing back through said shoe material, said centering means being disposed on the opposite side of said material from said feeding means, and reciprocating means for synchronously reciprocating said centering means along said first line of movement so as to center and position the loop prior to the passage of said needle through said material and to displace said guiding means away from said material when said needle is withdrawn from said material.

11. A machine as recited in claim 10 wherein said centering means comprises a head disposed adjacent to said needle, said head having a pointed projection formed on its lower portion is projected into and guides said loop, and reciprocating means for supporting said head with respect to said work surface.

12. A machine as recited in claim 11, wherein the head has a hollow seat formed so that said needle can pass through said seat, and wherein said reciprocating means further comprises means for reciprocating said head along said second line of movement.

* * * * *